US010280029B2

(12) United States Patent
Gahr et al.

(10) Patent No.: US 10,280,029 B2
(45) Date of Patent: May 7, 2019

(54) ACCUMULATOR FOR COLLATING PUNCH SYSTEM

(71) Applicants: Christoph Gahr, Villingen-Schwenningen (DE); Markus Gleichauf, Blumberg (DE); Berthold Schoch, Triberg (DE); Robert Rottweiler, Rottweil (DE); Tad Shupe, Boise, ID (US); Steven Parker, Boise, ID (US)

(72) Inventors: Christoph Gahr, Villingen-Schwenningen (DE); Markus Gleichauf, Blumberg (DE); Berthold Schoch, Triberg (DE); Robert Rottweiler, Rottweil (DE); Tad Shupe, Boise, ID (US); Steven Parker, Boise, ID (US)

( * ) Notice: Subject to any disclaimer, the term of this patent is extended or adjusted under 35 U.S.C. 154(b) by 0 days.

(21) Appl. No.: 15/631,520

(22) Filed: Jun. 23, 2017

(65) Prior Publication Data

US 2018/0370750 A1 Dec. 27, 2018

(51) Int. Cl.
*B65H 39/042* (2006.01)
*B26F 1/02* (2006.01)

(52) U.S. Cl.
CPC ..... *B65H 39/042* (2013.01); *B26F 1/02* (2013.01); *B65H 2301/4222* (2013.01); *B65H 2301/42266* (2013.01); *B65H 2408/11* (2013.01); *B65H 2801/27* (2013.01)

(58) Field of Classification Search
CPC .. B65H 2301/42266; B65H 2301/4213; B65H 2301/42132; B65H 2301/4222; B65H 31/3081; B65H 31/34; B65H 31/36
See application file for complete search history.

(56) References Cited

U.S. PATENT DOCUMENTS

| | | | | |
|---|---|---|---|---|
| 4,640,506 | A * | 2/1987 | Luperti | B65H 31/3027 271/212 |
| 5,887,864 | A * | 3/1999 | Stevens | B65H 39/10 270/52.07 |
| 6,293,544 | B1 * | 9/2001 | Fedinatz | B65G 17/26 198/626.5 |
| 7,185,883 | B2 | 3/2007 | Kato et al. | |
| 7,360,757 | B2 | 4/2008 | Anderson et al. | |
| 7,607,649 | B2 * | 10/2009 | Kapturowski | B43M 3/04 270/52.14 |
| 7,694,966 | B2 | 4/2010 | Hattori et al. | |
| 7,942,398 | B1 * | 5/2011 | Marcinik | B43M 3/04 198/626.5 |

(Continued)

*Primary Examiner* — Jeremy R Severson
(74) *Attorney, Agent, or Firm* — Progress Patent Law, PLLC; David R. McKinney

(57) ABSTRACT

An accumulator for an automatic sheet media punching and collating system includes a proximal end, having a shoulder, a distal end, and a moveable collating belt, disposed below the shoulder, extending from the proximal end to the distal end. The collating belt has an upwardly extending lower stop with an accumulating position opposite the shoulder, defining a drop region. The lower stop is configured to contact a lower edge of sheets of media sequentially received at the proximal end, whereby the sheets stop and accumulate in the drop region in a lift in a book order. The collating belt is selectively moveable to discharge the lift as a unit toward the distal end.

18 Claims, 10 Drawing Sheets

(56) References Cited

U.S. PATENT DOCUMENTS

| | | | | |
|---|---|---|---|---|
| 7,946,569 | B2 | 5/2011 | Hattori et al. | |
| 8,070,150 | B2 | 12/2011 | Tanaka et al. | |
| 8,146,909 | B2 | 4/2012 | Kuno et al. | |
| 8,162,306 | B2 * | 4/2012 | Suzuki | B65H 31/34 270/58.12 |
| 8,366,103 | B2 | 2/2013 | Kimata | |
| 8,398,067 | B2 | 3/2013 | Furuhashi et al. | |
| 8,672,313 | B2 | 3/2014 | Fukami | |
| 8,672,314 | B2 | 3/2014 | Yutaka et al. | |
| 8,733,753 | B2 | 5/2014 | Soga et al. | |
| 9,132,981 | B2 * | 9/2015 | Lee | B65H 31/3054 |
| 9,725,272 | B2 * | 8/2017 | Kimura | B65H 31/3045 |
| 2006/0237891 | A1 * | 10/2006 | Wirthwein | B65H 29/66 271/3.11 |
| 2007/0166130 | A1 * | 7/2007 | Kurabayashi | B42B 5/103 412/38 |
| 2009/0041496 | A1 | 2/2009 | Watanabe | |
| 2010/0295231 | A1 * | 11/2010 | Igata | B65H 31/34 270/58.12 |
| 2012/0056366 | A1 * | 3/2012 | Sekino | B65H 29/145 271/10.07 |
| 2015/0014913 | A1 | 1/2015 | Nishizawa et al. | |
| 2015/0028539 | A1 | 1/2015 | Dinnissen | |

* cited by examiner

ACCUMULATOR FOR COLLATING PUNCH SYSTEM

CROSS-REFERENCE TO RELATED APPLICATIONS

The present application is related to U.S. patent application Ser. No. 15/631,474 entitled COLLATING PUNCH SYSTEM, filed concurrently with the present application.

BACKGROUND

Field of the Invention

The present application relates generally to paper-punching systems for punching holes in pages in preparation for binding of booklets, proposals and the like. More particularly, the present application relates to an accumulator having a stopping and aligning mechanism, configured to gather and align a group of sheets of media in preparation for punching the holes.

Related Art

Multi-hole punching systems are widely used for preparing sheet media for binding with comb- or coil-type bindings, such as are shown in FIG. 12. Such punching systems come in a variety of styles and sizes depending on the type of binding, the dimensions of the sheet media, etc. When binding a document, report or other book using a comb-type or coil-type binding, the body pages of the document are usually first printed and collated, which is relatively easily done with high speed printing and copying systems that are widely available today. Where sheets of multiple types are to be combined in a single document, such as front and back covers, divider pages, cardstock, etc., these may be collated with the body pages or retained separately until the binding step, but are often collated by hand, which is relatively labor-intensive.

The collated body pages and the divider pages, covers, etc. are then punched with holes for binding. The pages of all types can be punched individually, either prior to or after collation, using a punching device that simultaneously punches all of the binding holes along an edge of the sheets, or they can be divided into lifts of a few sheets (e.g. 10 sheets each), and then inserted into the punching device that punches all of the binding holes in the entire lift. Manual-type multi-hole punches are widely used, and typically include a punch lever that is connected to a multi-hole punching die. The user inserts one edge of a sheet or lift of sheets beneath the die, and then punches the holes by pushing down on the lever. Power operated multi-hole punches are also available. Punching in lifts of a limited number of pages is typical because of the force required to simultaneously punch multiple holes through a stack of paper.

The individual sheets or individual lifts are punched one by one, and are then sequentially assembled on the forks of a binding machine, with the divider pages, covers sheets, etc. collated with the body pages. Once all body pages and other sheets are properly placed, the binding device (e.g. comb binding or coil binding) is inserted through the aligned holes in the sheet media to bind the punched edges.

It will be apparent that this process can take a significant amount of human labor in collating, punching, arranging and binding the sheets of media. This naturally increases the cost of the finished book, and also tends to increase the time involved in producing each copy. The present application is directed toward one or more of the above-mentioned issues.

SUMMARY

It has been recognized that it would be advantageous to develop a system that rapidly punches pages of a variety of types in preparation for binding.

It has also been recognized that it would be advantageous to have a system that automatically collates and punches pages of media into units for binding at a high speed.

In accordance with one embodiment thereof, the present invention provides an accumulator for an automatic sheet media punching and collating system. The accumulator includes a proximal end, having a shoulder, a distal end, and a moveable collating belt, disposed below the shoulder, extending from the proximal end to the distal end. The collating belt has an upwardly extending lower stop with an accumulating position opposite the shoulder, defining a drop region. The lower stop is configured to contact a lower edge of sheets of media sequentially received at the proximal end, whereby the sheets stop and accumulate in the drop region in a lift in a book order. The collating belt is selectively moveable to discharge the lift as a unit toward the distal end.

In accordance with another aspect thereof, the invention provides an accumulator for a sheet media punching and collating system having a multi-source sheet media intake mechanism and a punching die assembly. The accumulator includes an inlet, having a shoulder, configured to be disposed adjacent to the multi-source sheet media intake mechanism, and an outlet, configured to be disposed adjacent to the punching die assembly. The accumulator further includes a pair of selectively moveable collating belts, disposed below the shoulder, and a pair of selectively moveable tapping belts, disposed below the shoulder and parallel to the collating belts. The collating belts each have an upwardly extending lower stop, and an accumulating position with the lower stops opposite the shoulder, defining a drop region between the lower stops and the shoulder. A lower edge of sheets of media received at the inlet can contact the lower stops and sequentially accumulate in the drop region in a book order to form a lift. The tapping belts each have an upwardly extending upper stop, and are moveable independently of the collating belts to contact an upper edge of the lift to align the sheets, and are moveable in concert with the collating belts to discharge the lift through the outlet to the punching die assembly.

In accordance with yet another aspect thereof, the invention provides a method for accumulating a selected quantity of sheets of media in an automatic punching and collating system having a multi-source sheet media intake mechanism and a punching die assembly. The method includes receiving into an accumulator, one at a time in a book order, finished media sheets from the multi-source sheet media intake mechanism, stopping a first selected quantity of the finished media sheets, in the book order, upon a stopping mechanism in a drop region in the accumulator, and discharging the first selected quantity of finished media sheets, as a unit, to the punching die assembly for punching, using the stopping mechanism.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
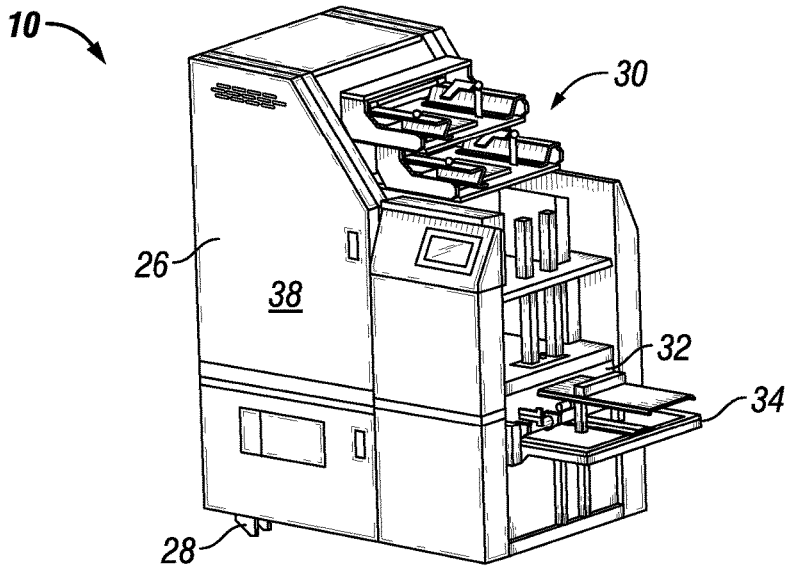
FIG. 1 is a perspective view of one embodiment of a collating punch system in accordance with the present disclosure.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As noted above, the process of collating and punching sheets of media of different types in preparation for binding can be time-consuming and labor-intensive. Prior methods can involve separate steps of collating the different types of sheet media, then punching binding holes in sheets individually or in groups or "lifts" before binding them. Alternatively, the sheets of different types can be punched individually or in groups, then collated together into the desired order for the completed book before binding but after punching is complete. Even with the use of power-operated punching systems and other aids for collating the sheets, these prior approaches to binding documents can be undesirable in a variety of ways.

Figure 2:
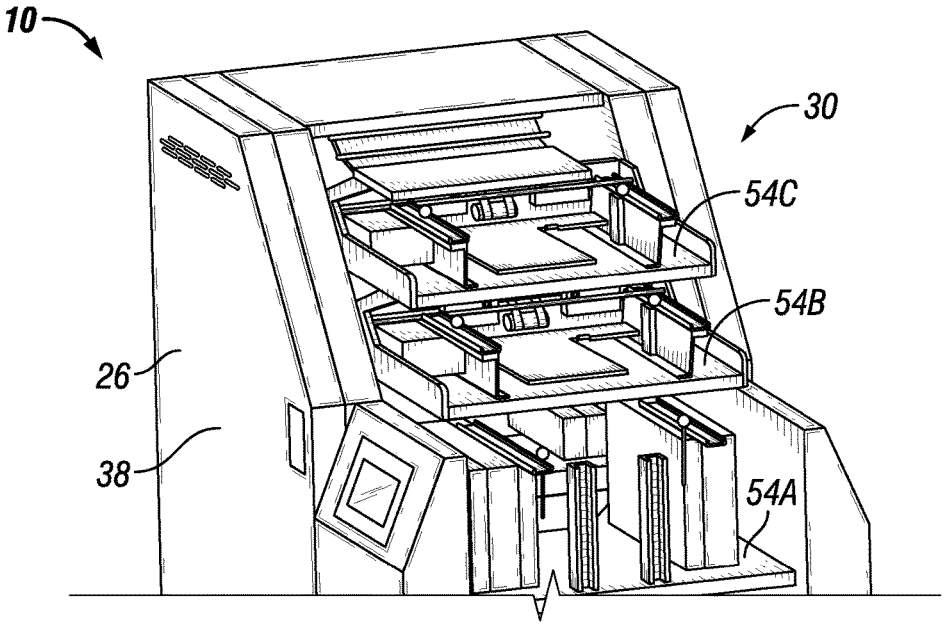
FIG. 2 is a detail perspective view of the sheet feeding units.
Figure 3:
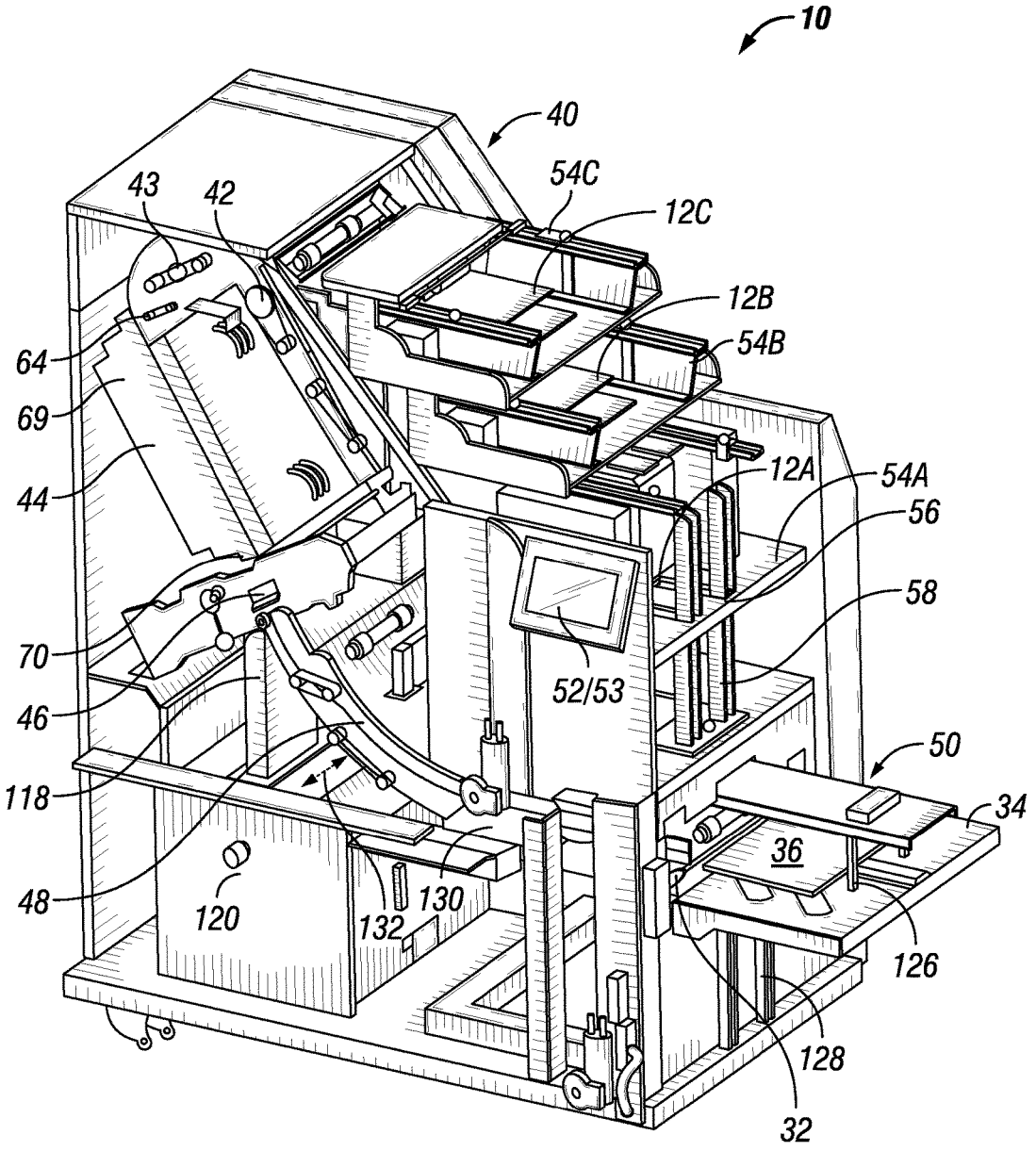
FIG. 3 is a side perspective view of the high-speed collating punch system of FIG. 1, with the side panel removed, showing the major internal components.
Figure 15:
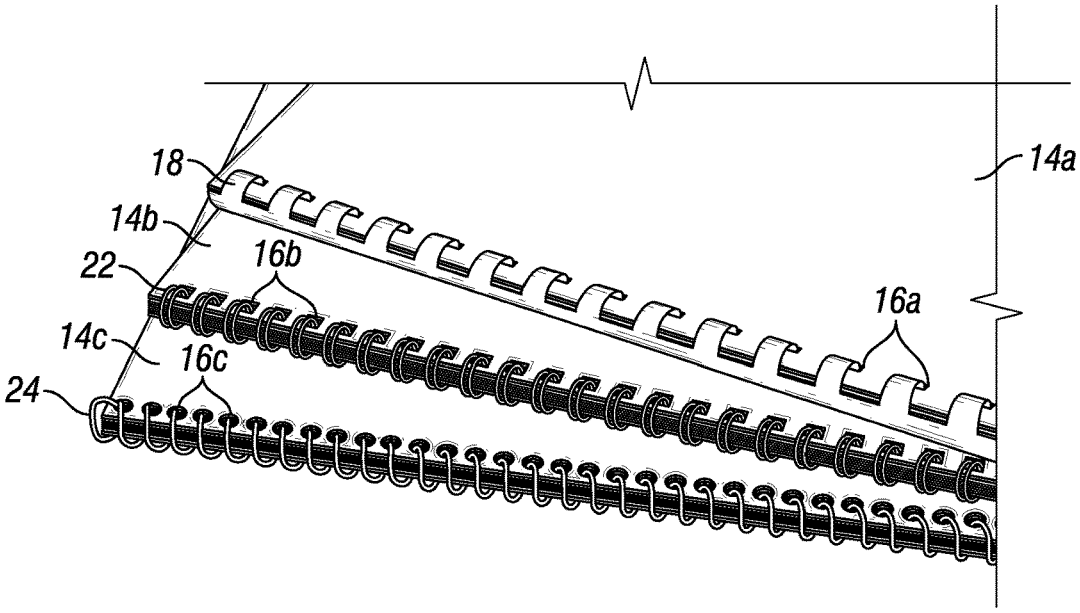
FIG. 15 is a partial perspective view of several completed books with comb-wire- and coil-type bindings.

Referring to FIGS. 1-4, the present disclosure provides a paper punching and collating system, indicated generally at 10, which can rapidly collate and punch holes in sheet media of multiple types, indicated generally at 12 in FIG. 3, in preparation for binding with comb-type, wire-type, coil-type or other bindings. Partial perspective views of several completed books 14 with comb-wire- and coil-type bindings, respectively, are shown in FIG. 15. In this view one completed book 14*a* includes sheets 12 having rectangular holes 16*a* and a comb-type binding 18. Another completed book 14*b* includes sheets 12 having rectangular holes 16*b* with a different size, shape and spacing than the rectangular holes 16*a*, with a wire-type binding 22. The third completed book 14*c* includes sheets 12 having circular holes 16*c* and a coil-type binding 24, also called a spiral binding. Other punching and binding configurations are also used, and the paper punching and collating system 10 disclosed herein is equally applicable to many other configurations.

Viewing FIGS. 1-4, one embodiment of a paper punching and collating system or machine 10 in accordance with the present disclosure is shown. This machine 10 is about the size of a medium sized photocopier, and is enclosed in a cabinet 26 with supports 28, such as casters, that support the machine 10 on a floor and can also be configured to allow the system to be moved and positioned as desired. The paper punching and collating system 10 generally includes an inlet region 30 for receiving sheets of media 12 to be collated and punched, and a discharge slot 32 adjacent to an output tray 34 from which punched groups or "lifts" 36 (shown in FIGS. 10 and 11) of sheets 12 that have been discharged can be retrieved by a user and moved to a binding device (not shown).

Figure 4:
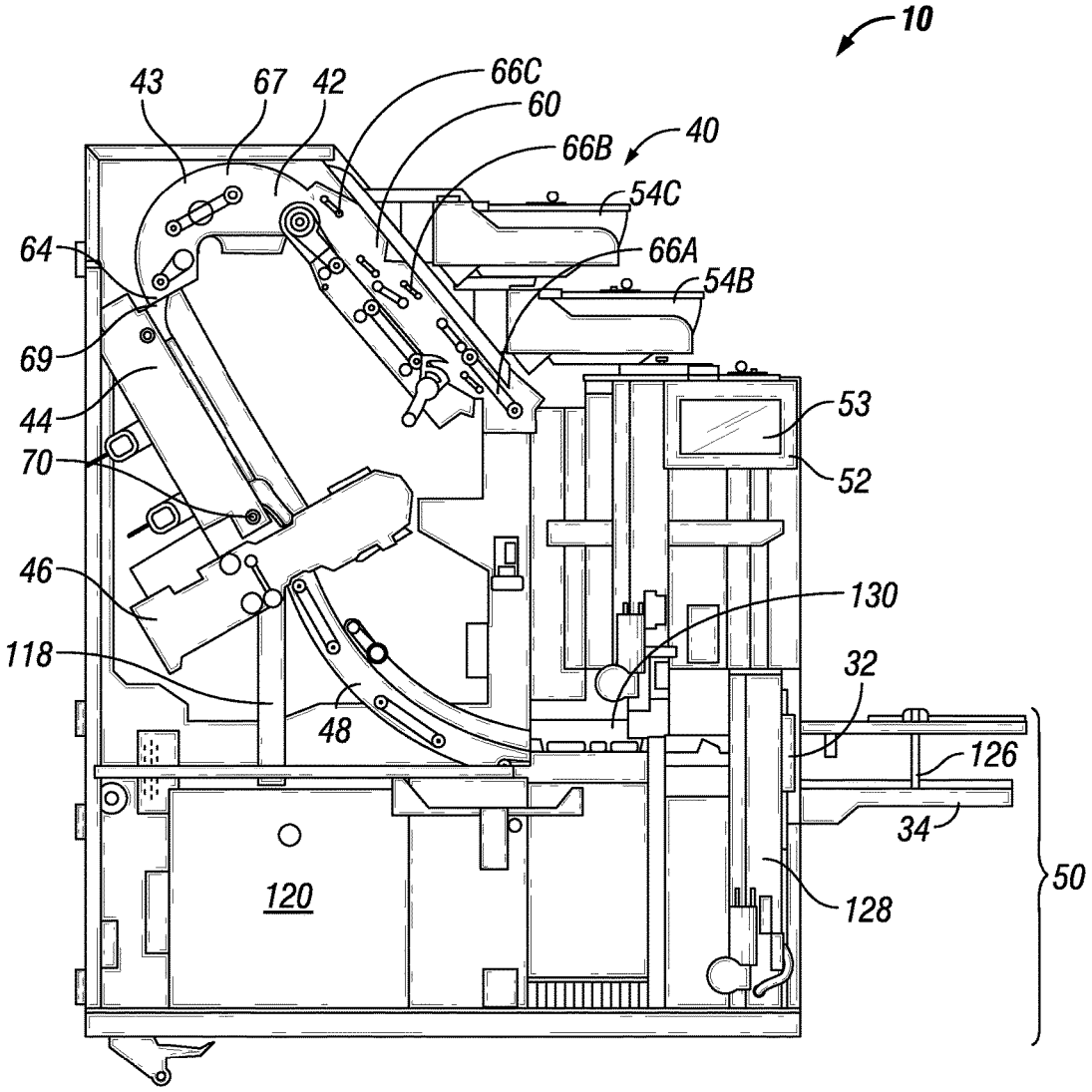
FIG. 4 is a side view of the high-speed collating punch system of FIG. 1, with the side panel removed, showing the major internal components and the media path.

Shown in FIGS. 3 and 4 are perspective and side views, respectively, of the system 10 of FIG. 1, with the front panel 38 of the cabinet 26 removed, showing the internal parts of the device. This paper punching and collating system 10 generally includes a multi-source sheet media intake and transport mechanism, indicated generally at 40, which includes multiple sheet feeder devices 54 and a sheet transport mechanism 42, and further includes an accumulator 44, a punching die assembly 46, a discharge mechanism 48 and an output tray assembly 50. The system 10 also includes a computer controller 52 with a user interface, such as a touch screen 53, which allows a user to control operational characteristics of the machine 10 and select from a variety of operational features, and to receive error and other condition notifications.

The controller 52 can be a common microcontroller with a CAN bus (not shown) connecting the controller to each of the assemblies, components and sensors of the system 10. Such controllers are widely available, and can be programmed and operated using well known software, such as Linux, for example. Alternatively, a programmable logic controller (PLC) can also be used as the controller. The controller 52 is coupled to and configured to selectively actuate the sheet feeder devices 54, the transport mechanism 42, the accumulator 44, the punching die assembly 46, the discharge mechanism 48 and the output tray assembly 50 so that collated lifts 36 of sheets 12 of multiple types are sequentially gathered and punched according to a selected book configuration programmed into the controller 52.

In one embodiment, the various components of the paper punching and collating system 10 can be configured to punch and collate at a rate of more than 10,000 sheets per hour, depending on the configuration of the final book and other factors. Higher sheet punching and collating rates can be achieved in a variety of ways, such as by increasing the number of sheets per lift. On the other hand, the paper punching and collating rate can be downwardly affected by factors such as a complex book configuration, such as having many divider pages, small lifts (i.e. fewer sheets per lift), thicker media, etc.

The multi-source sheet media intake and transport mechanism 40 includes multiple sheet feeder devices, indicated generally at 54, which are shown most clearly in FIG. 2. The number of sheet feeder devices 54 can vary, but is at least two. In the embodiment of the paper punching and collating system 10 shown herein, three sheet feeding devices 54*a*-54*c* are provided, but a larger number can also be used. Each sheet feeder device 54 is configured to hold finished sheets of media 12 in a face-up orientation, and these can be any of a wide variety of types of sheet media 12, such as are used in printing and publishing, including paper, cardstock, vinyl, acetate film, etc. The terms "page," "pages," "paper," "sheets," "media," "sheet media" and variants thereof are used interchangeably herein to refer to any type of sheet media, whether paper, cardstock, vinyl, acetate, or any other type of sheet material that can be included in a book. Additionally, the term "type of media" or similar terms used herein have reference to any and all characteristics of sheet media, including the size (e.g. body pages vs. larger cover sheets) and shape (e.g. pages with tabs vs straight-edged pages), the material of the media (e.g. paper, cardstock, vinyl, acetate film, etc.), the condition of the media (e.g. printed vs. blank) and the function of the particular sheet of media (e.g. body pages, covers, divider pages, etc.).

The term "finished" is used herein to indicate that the sheets of media 12 that are placed in the sheet feeders 54 are presumed to include any printing, indicia or other treatment, as desired, that is intended for their finished presentation in the ultimate book. For example, the sheets 12 that constitute covers, body pages, etc. for a book are expected to be completely printed, cut to shape (e.g. provided with tabs, where applicable), etc., prior to placement in the respective sheet feeder 54 for punching and collating. It is to be understood that some sheets 12, such as divider pages, back covers, and perhaps body pages in certain circumstances, may be intended to have no printing at all in their final bound condition. Such sheets are nevertheless considered to be "finished" for purposes of this application even if they are completely blank. Indeed, a book entirely of blank pages can be collated and punched using the system 10 disclosed herein, and such pages are considered to be "finished" for purposes of this application.

The sheet feeding devices 54 can be air-lift paper feeding mechanisms, which provide a flow of air upon the sides of a stack of media sheets 12 to separate the individual sheets at the top of the stack, and a suction fan (not shown) above each stack to lift the top sheet 12 in the stack so that the top sheet can be picked very rapidly with high accuracy (i.e. few mispicks or multiple picks). A suitable air-lift paper feeding mechanism that can be used in the system disclosed herein is the Tornado system that is commercially available from BDT Media Automation GmbH of Rottweil, Germany. This type of air lift sheet feeder can be configured to pick and feed individual sheets very rapidly and very accurately for many types of media.

In the embodiment shown in the figures, the paper punching and collating system 10 includes three sheet feeder devices 54*a*-54*c*, as shown most clearly in FIGS. 2 and 3, and each of these can, if desired, hold a supply of a different type of media 12. Thus, for example, a first paper feeding mechanism 54*a* can hold a supply of printed body pages 12*a* for the book, a second paper feeding mechanism 54*b* can hold a supply of divider pages 12*b* for the book, while the third paper feeding mechanism 54*c* can hold cover sheets 12*c* for the book. The sheets 12 in each feeder 54 are arranged in a selected book order for the respective type of media. That is, for the example above, the body pages 12*a* are arranged in their respective page order in successive groups (one group for each book), the divider pages 12*b* are arranged in their page order for each book, and the front and back covers are in their order in a stack in the input tray of each respective sheet feeder 54. In this embodiment, the body sheet feeder 54*a* has the largest sheet capacity, and the two smaller capacity sheet feeders 54*b*, 54*c* are used for the dividers and covers (i.e. specialty sheets), which are typically fewer in number per book. The body sheet feeder 54*a* includes a support tray 56 and lift mechanism 58, which allows the body sheet feeder 54*a* to hold and lift a large stack of sheets 12 toward the inlet of the respective sheet feeder 54*a*. This allows a very large stack to be effectively handled and oriented to feed sheets into the system 10.

The multiple sheet feeding mechanisms 54 are coupled to the controller 52, and are selectively actuated by signals from the controller 52 to pick and feed the multiple different types of sheet media 12 one sheet at a time in the desired final book order into an inlet 60 of the sheet transport mechanism 42. Each sheet feeding mechanism 54 can include a sheet counter or sensor, indicated generally at 66, such as a photosensor, at its distal end to detect the passage of a sheet from the respective feeding mechanism. These sheet sensors 66 are coupled to the controller 52, and provide signals that allow the controller 52 to maintain a continuous count of the sheets 12 drawn from each sheet feeding mechanism 54 and introduced into the sheet transport mechanism 42. The sensors 66 allow the controller 52 to detect the actual entry of sheets 12 into the inlet 60 of the sheet transport mechanism 42, allowing the controller 52 to thereby sense the timing and quantity of sheets 12 that enter into the accumulator 44, in response to sheet picking and feeding signals that are sent to the various sheet feeding devices 54.

The sheet transport mechanism 42 can be similar to sheet media transport systems that are commonly used in photocopiers. Such systems generally include guides 61, drive rollers 62, belts 63, etc., which operate to move individual sheets 12 from the inlet 60 to the outlet 64 of the sheet transport mechanism. As can be seen in FIGS. 3 and 4, the sheet transport mechanism 42 in the paper punching and collating system 10 disclosed herein draws individual sheets of media 12 upward at an angle into the machine 10 (from right to left in the figures), through an arched section 43, and then directs the sheets downward at an incline to the toward the accumulator 44. The arched section 43 provides in inverting portion that inverts the sheets 12 as they pass therethrough. That is, the sheets 12 pass into the inlet 60 of the sheet transport mechanism 42 face-up, but after passage through the arched section pass out of the outlet 64 and into the accumulator 44 face down.

Disposed along the sheet transport mechanism 42, such as in the arched section 43, is a multi-pick sensor 67. This sensor 67 is coupled to the controller 52 and can be a density sensor that detects the density of passing sheets 12 as they pass by. A density signal that is inconsistent with (i.e. higher than) a respective type of media can indicate that multiple sheets have been picked, which is undesirable. In response to such a signal, the controller 52 can halt operation of the system 10, allowing a user to correct the situation before continuing. Those of skill in the art will recognize that picking and feeding multiple pages at a time, rather than individual sheets, can lead to paper jams in the system 10. Additionally, since the pages in each lift are intended to be picked in a specific page order or book order for a particular book in this system 10, two or more pages passing through the system where just one page is expected will alter the order of the pages, which affects the accuracy of the collation process.

As can be seen in FIGS. 3 and 4, the accumulator 44 is positioned adjacent to the outlet 64 of the sheet transport mechanism 42 and above the punching die assembly 46. The accumulator 44 receives sheets 12 from the outlet 64 of the sheet transport mechanism 42, and sequentially gathers and aligns a selected number of the sheets into a sheet lift 36. The accumulator 44 thus provides a stopping and aligning mechanism, which gathers and aligns the programmed number and type of sheets 12 in each lift 36. The accumulator 44 is oriented at an incline between the sheet media intake mechanism and the punching die assembly 46, with the inlet or proximal end 69 of the accumulator 44 at an upper position and the outlet or distal end 70 of the accumulator 44 at a lower position. This orientation of the accumulator 44 allows gravity to assist in its operation, as described in more detail below.

The number, type and order of sheets 12 in each lift 36 are programmed into the controller 52, which actuates the sheet feeders 54 to pick the designated sheets 12, and these are detected and counted by the sheet counter 66 prior to the sheets' entry into the sheet transport system 42. The number of sheets 12 in each lift 36 can vary, based on operator input and machine efficiencies, and in view of media characteristics. In general, 10 sheets of plain paper are considered to be a typical suitable quantity that can be punched at once by the punching die assembly 46, as described below, while still being large enough to simplify and speed the process of binding. It will be apparent that lifts of other sizes can also be used, depending on the configuration and power of the punching die assembly 46 and the nature of the sheet media 12 (e.g. plain paper vs. bond paper vs cardstock, etc.). Additionally, specialty sheets, such as divider pages, covers, etc., can be transported and punched in lifts of just 1 sheet per lift.

Figure 10:
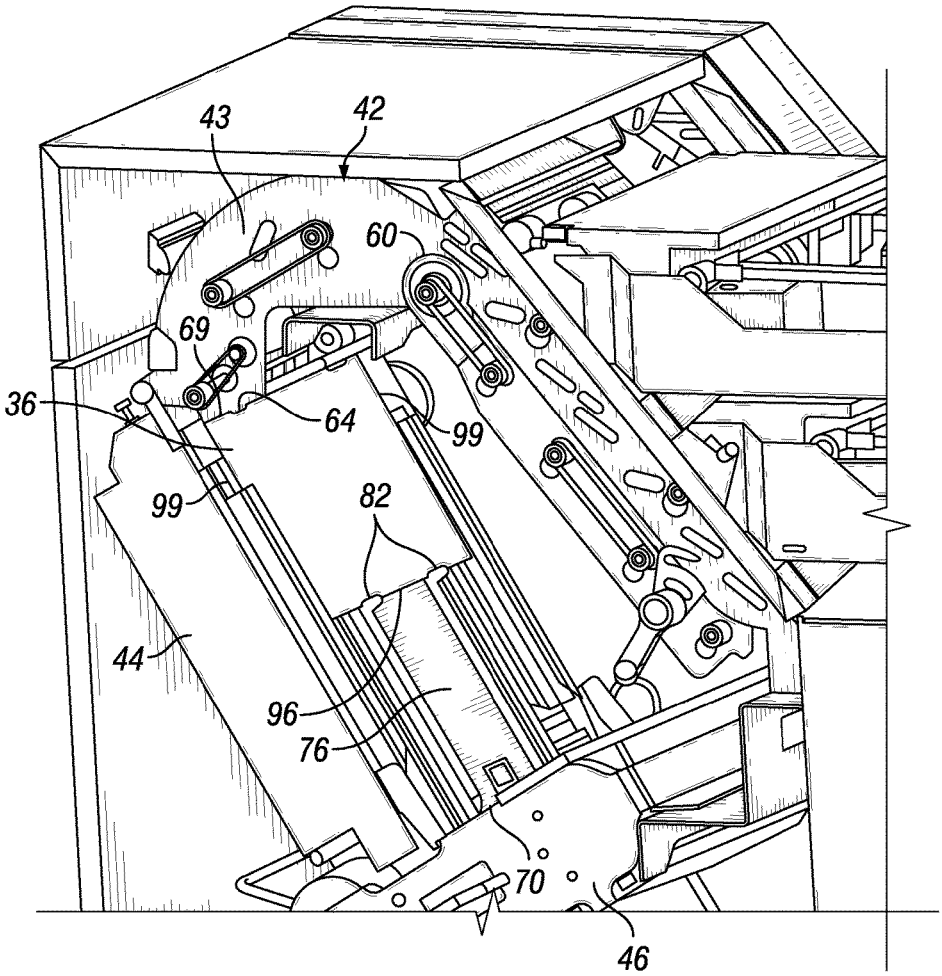
FIG. 10 is a perspective view of the accumulator in the high-speed collating punch system of FIG. 1, showing the internal portion of the accumulator as sheet media is received therein.
Figure 11:
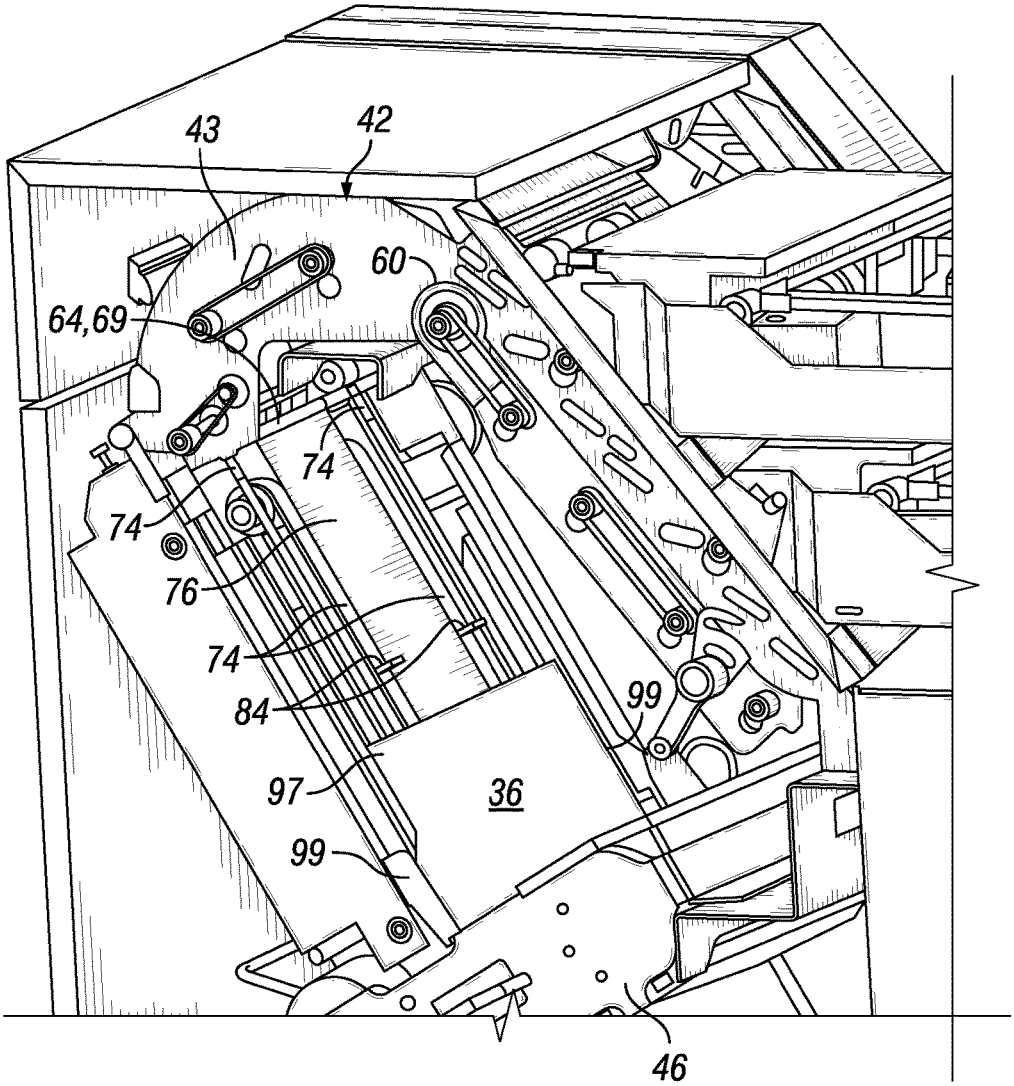
FIG. 11 is a perspective view of the accumulator in the high-speed collating punch system of FIG. 1, showing the internal portion of the accumulator as a complete lift of sheet media is discharged therefrom into the punching die.

FIGS. 10 and 11 show partial perspective views of the accumulator 44 in operation in the high-speed collating punch system 10. The accumulator 44 is shown with its upper frame 68 removed in these views, so that the internal parts of the accumulator are visible. Provided in FIG. 5 is a perspective view of one embodiment of the accumulator unit 44 removed from the collating punch system 10, and FIGS. 6 and 7 provide perspective views of this accumulator 44 with the upper frame removed.

Figure 5:
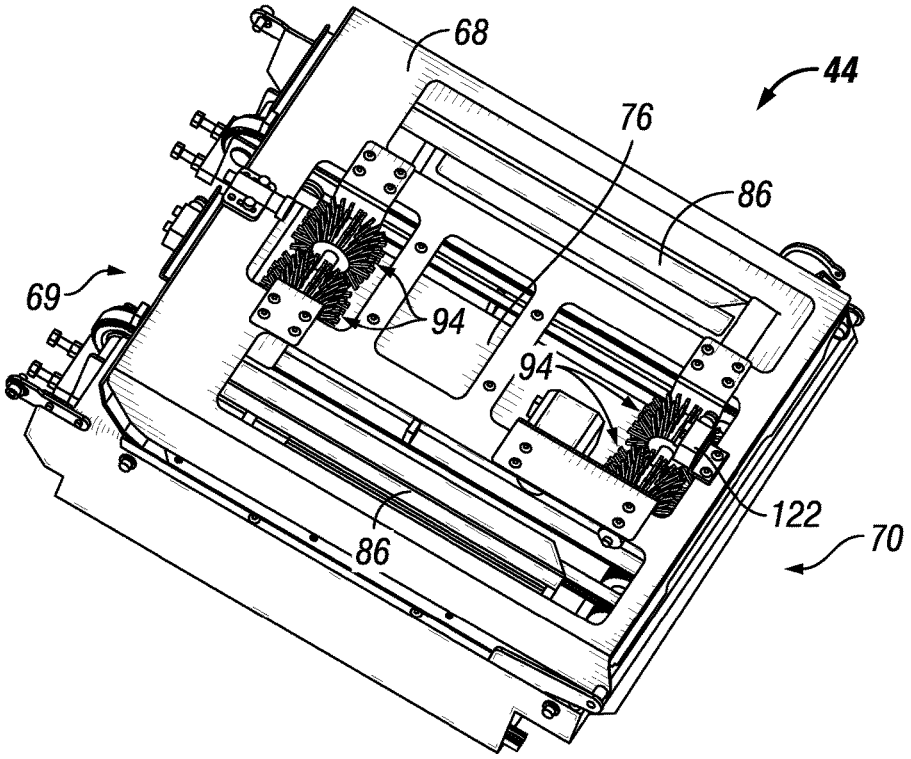
FIG. 5 is a side perspective view of one embodiment of an accumulator unit that can be used in the high-speed collating punch system of FIG. 1.
Figure 6:
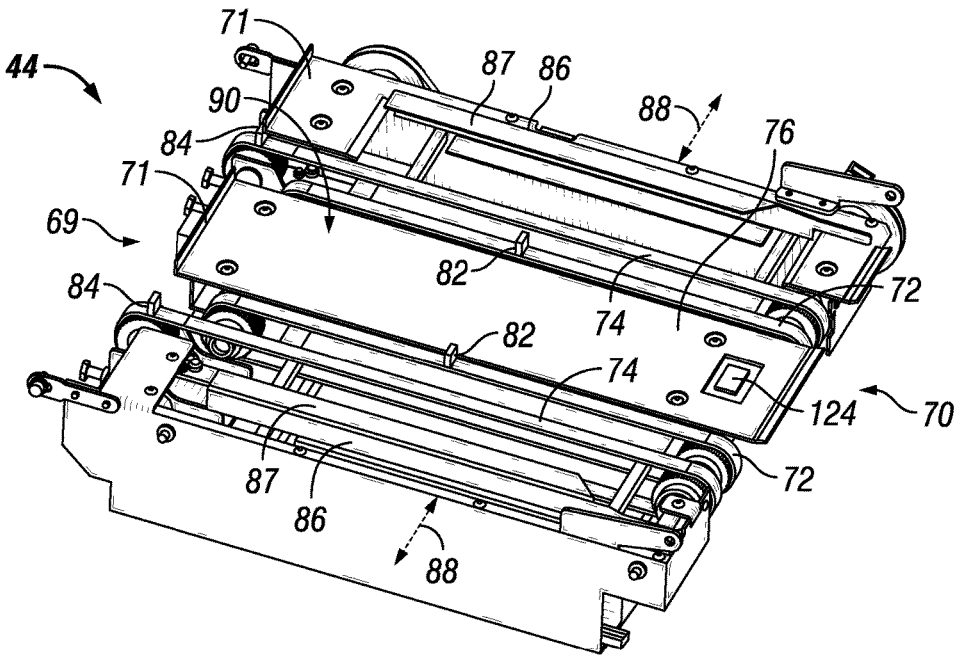
FIG. 6 is a side perspective view of the accumulator unit of FIG. 5 with the upper frame removed, showing the internal components of the device.
Figure 7:
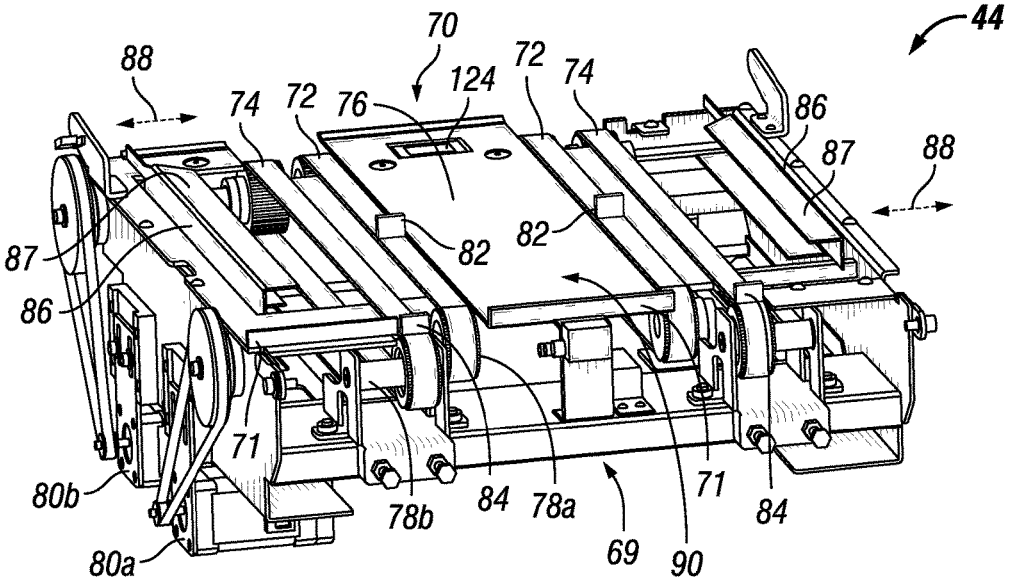
FIG. 7 is a top perspective view of the accumulator unit of FIG. 5, showing the media support surface and the belt drive motors.

Referring to FIGS. 5-7, the proximal or inlet end 69 of the accumulator 44 is configured to be located adjacent to the outlet 64 of the media transport system 42, and the distal or discharge end 70 is configured to be located adjacent to the punching die assembly 46. The accumulator includes a pair of collating belts 72 and a pair of tapping belts 74 that extend generally from the proximal end 69 to the distal end 70. While two of each type of belt 72, 74 are shown in the figures, it is to be appreciated that more than two or less than two of each type of belt can be used. For example, a single, centrally positioned collating belt 72 could be used with a pair of tapping belts 74 disposed generally symmetrically on either side thereof, or vice versa. It is generally considered desirable that the belts are positioned in a symmetrical arrangement in order to help keep sheet media properly aligned within the accumulator 44.

As best seen in FIGS. 6 and 7, the collating and tapping belts 72, 74 are endless belts that are parallel to each other and disposed around driving wheels and pulleys, indicated generally at 78. The collating and tapping belts 72, 74 can be positioned on opposing lateral sides of a centrally positioned media support surface 76, which also generally extends from the proximal end 69 to the distal end 70 of the accumulator 44, and serves to support, in concert with the collating and tapping belts 72, 74, sheet media 12 received in the accumulator 44. As best shown in FIG. 7, the collating and tapping belts 72, 74 can be positioned with their upper surfaces generally planar with or slightly below the level of the media support surface 76.

The drive wheels 78 for the collating and tapping belts 72, 74 are connected via drive pulleys and drive belts to respective drive motors 80*a*, 80*b*, which can be stepper motors, for example. The drive motors 80 are coupled to the controller 52, and are configured to cause independent selective motion of the respective belts 72, 74 in response to signals from the controller 52. That is, the collating belts 72 are attached to one drive wheel 78*a* and its associated motor 80*a*, while the tapping belts 74 are attached to the other drive wheel 78*b* and its associated motor 80*b*. Thus, the drive motors 80 can move the collating belts 72 and the tapping belts 74 independently of each other at any distance or direction, and at any speed under signals from the controller 52.

As best seen in FIGS. 6 and 7, the proximal or inlet end 69 of the accumulator 44 includes a shoulder 71, which defines a drop from the outlet 64 of the media transport mechanism 42. This shoulder 71 can be provided by an upward extension of the media support surface 76 at the proximal end 69, and additional upward features that are disposed outwardly of the collating and tapping belts, as shown. It is to be understood that this is just one method for providing the shoulder, and other structures for creating this shoulder can be used.

The collating belts 72 include upwardly extending lower stops 82, which extend above the level of the media support surface 76 and are generally parallel to the shoulder 71. The collating belts 72 can be moved to place the lower stops 82 in an accumulating position, opposite the shoulder 71. In the accumulating position, the lower stops 82 are configured contact the lower edges (96 in FIG. 10) of sheets of media 12, and stop these sheets as they are received in the accumulator 44, until a selected quantity of sheets are stopped to form a lift 36. The accumulating position of the collating belt 72 and thus of the lower stops 82 is adjustable, under the control of the controller 52, based on the size of sheet media 12 to be received in the accumulator 44. For example, where letter size paper is to be accumulated and punched on its long side edge, the controller 52 sends signals to move the collating belts 72 so that the lower stops 82 are positioned slightly more than 8.5" (the width of letter paper) from the shoulder 71, so that the sheets can easily drop and accumulate between the shoulder 71 and the lower stops 82.

The distance between the shoulder 71 and the lower stops 82 in any given accumulating position thus defines a drop region, indicated generally at 90, for the media sheets 12 in the accumulator 44. The lower edges 96 of sheets 12 that enter the accumulator 44 from the outlet 64 of the transport mechanism 42 contact the lower stops 82 and drop into the drop region 90 in a "shingle-type" fashion, each sheet passing over and falling atop the preceding sheet, thus retaining the original sheet order. The lower stops 82 thus provide a stopping and accumulating mechanism for stopping the sheets 12, which allows the sheets 12 to accumulate in a lift 36 of sheets in the book order. The position of the collating belts 72 below the shoulder 71 thus allows each sheet 12 to drop below the shoulder 71 into the drop region 90, so that the next sheet that comes along the paper path travels above and falls upon the preceding sheet without hooking it. In this process, the lower stops 82 also initially align the lower edges 96 of the sheets 12. Thus, the collating belts 72 and their lower stops 82 comprise the primary parts of the stopping and aligning mechanism disclosed herein, though the tapping belts 74 and upper stops 84 can also be considered part of the stopping and aligning mechanism, too. This step in the process is shown in FIG. 10, where a lift 36 of sheet media 12 is being received in the accumulator 44 and stopping against the lower stops 82 of the collating belts 72.

Referring again to FIGS. 6 and 7, the tapping belts 74 each include an upwardly extending upper stop 84, which is similar in size and configuration to the lower stops 82. When media sheets are entering the accumulator 44 and falling into the drop region 90 against the lower stops 82, the upper stops 84 are positioned out of the drop region 90, so as not to impede the ingress of the sheets 12. For example, the upper stops 84 can be positioned in line with or behind the shoulder 71 during the accumulation process, as shown.

The upper stops 84 make up part of a tapping mechanism, and also assist in transporting accumulated lifts 36 within the accumulator 44. After all sheets 12 for a given lift 36 have been accumulated in the drop region 90, the upper stops 84 are brought into contact with the upper edges 97 of the lift 36 of sheets 12, and the tapping belts 74 move in concert with the collating belts 72 to move the lift 36 as a unit to the discharge 70 of the accumulator 44, and into the media slot (112 in FIGS. 12 and 13) of the punching die assembly 46. Before and/or after this motion, the tapping belts 74 can be activated in a reciprocal motion to tap against and align the upper edges 97, to ensure that the lift 36 is properly aligned from top to bottom. This helps to correct for any possible top-to-bottom misalignment of the sheets 12 that might occur as they are received in the drop region 90 of the accumulator 44. The collating belts 72 and tapping belts 74 continue to lower the lift 36 (which is resting on the lower stops 82) toward the discharge 70 of the accumulator 44 until the lower edge 96 of the lift 36 enters the media slot 112, as illustrated in FIG. 11. It is to be appreciated that the media collating and punching system disclosed herein could be configured without the collating belts 74, in which case the completed lift 36 can be discharged from the accumulator by the lowering action of the lower stops 82 alone, the lift 36 being held on the lower stops 82 and dropping within the accumulator 44 under the force of gravity as the collating belts 72 move. In this way, the lift 36 of media sheets can be discharged as a unit to the punching die assembly 46 for punching, using the stopping mechanism alone.

A pair of reciprocable side bars 86 are disposed on opposing lateral sides of the media support surface 76 of the accumulator 44. These side bars 86 are configured to move symmetrically inward, as indicated by arrows 88, from a resting position some small distance (e.g. ¼") outside of the nearest lateral edges 99 of the sheets, to a contacting position to contact and align the lateral edges (99 in FIGS. 10, 11) of the sheets of the lift 36, and also to center the sheets 12 of the lift 36 within the accumulator 44. This helps to prepare the lift 36 for proper punching alignment. Like the upper stops 84 of the tapping belts 74, the side bars 86 are part of the tapping mechanism disclosed herein, and can move in a repeated reciprocating motion from the resting position to the contacting position, and thus contact the sheet edges one or more times to help align them. The side bars 86 can also include upper guide surfaces 87, which help to vertically guide and retain sheets 12 and limit their movement in the drop region 90 while entering the accumulator 44.

The moveability of the side bars 86 also allows the accumulator 44 to automatically accommodate sheet media 12 of differing sizes for different books, or media of different sizes that might be incorporated into a single document or book 14, based on appropriate signals from the controller 52. When larger or smaller sheets (relative to the lateral dimension of the accumulator) are to be received into the accumulator 44, the controller 52 can actuate the side bars 86 to move inwardly or outwardly to an appropriate spacing for the next sheets to be received, while still performing the aligning and centering function as discussed above. For example, if a first document to be punched is printed on letter size paper (8.5"×11") and a second document is on A4 paper (8.27"×11.69" or 210 mm×297 mm) the side bars 86 can have a first resting position and a first contacting position which correspond to the dimensions of the letter paper, and second resting and contacting positions that correspond to the dimensions of the A4 paper. The magnitude of inward motion of the side bars 86 and the relative position of the punch pattern on the media will also be adjusted to accommodate different sizes of media.

Figure 13:
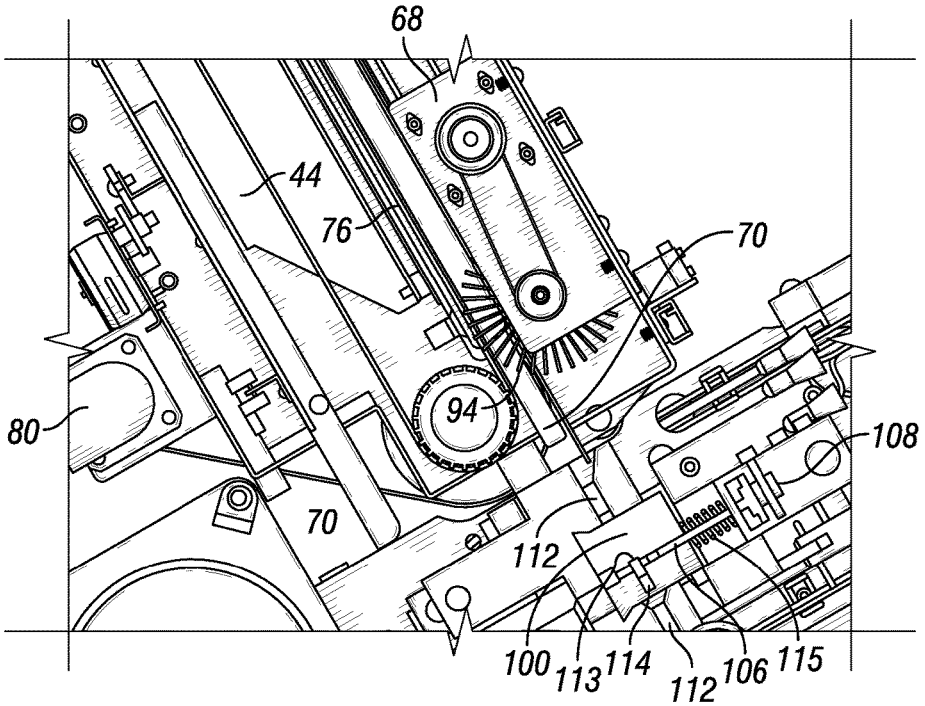
FIG. 13 is a cross-sectional view of the discharge region of the accumulator in relation to the feed slot of the punching die unit.

Referring to FIG. 5, the accumulator 44 also includes an upper frame 68, which can be hingedly attached to the accumulator 44 so that it can be opened for maintenance, removal of blockages, etc. With a hinged connection, the upper frame 68 can have a closed (i.e. operating) position, shown in FIG. 5, and an open position, shown in another embodiment of the accumulator in FIG. 9. Referring to FIG. 6, the upper frame 68 can include a media driving mechanism, which in this embodiment includes rotatable brushes 94 that are positioned to lie opposite the media support surface 76 and contact the back sides of sheets 12 that are received into the accumulator 44 when the upper frame 68 is in the closed position for operation. The brushes 94 can be powered by a single motor 95, such as a stepper motor, which can be connected to multiple drive axle via drives belts and pulleys and actuates the brushes to counter-rotate relative to the direction of motion of the collating belts 72 and tapping belts 74 and assist in moving individual sheets 12 and/or a completed lift 36 within the accumulator 44. A cross-sectional view of the discharge region 70 of the accumulator 44 is shown in FIG. 13. In this view, the spatial relationship of the lower brushes 94 to the media support surface 76 near the distal end 70 of the accumulator can be seen. Since the brushes 94 are positioned opposite the media support surface 76 and the collating and tapping belts 72, 74, the counter-rotation of the brushes 94 relative to these belts will facilitate movement of the sheets 12 and the lift 36 that is positioned between these features.

Advantageously, the drive brushes 94 provide gentle contact with the back side and upper edges (97 in FIG. 11) of sheets of media, and are particularly desirable where sheets with irregular edges (e.g. divider tab pages) are involved. That is, where a divider sheet or the like has an upper edge 97 that is not straight, the upper stops 84 of the tapping belts 74 may not both contact the upper edge 97. This can introduce forces that can tend to misalign or tilt an individual sheet 12 or an entire lift 36 within the accumulator 44, which is undesirable. Thus, where sheets 12 with irregular upper edges 97 are involved, the brushes 94 can help push against the upper edge in a location along the upper edge 97 where an upper stop 84 does not contact it.

Figure 8:
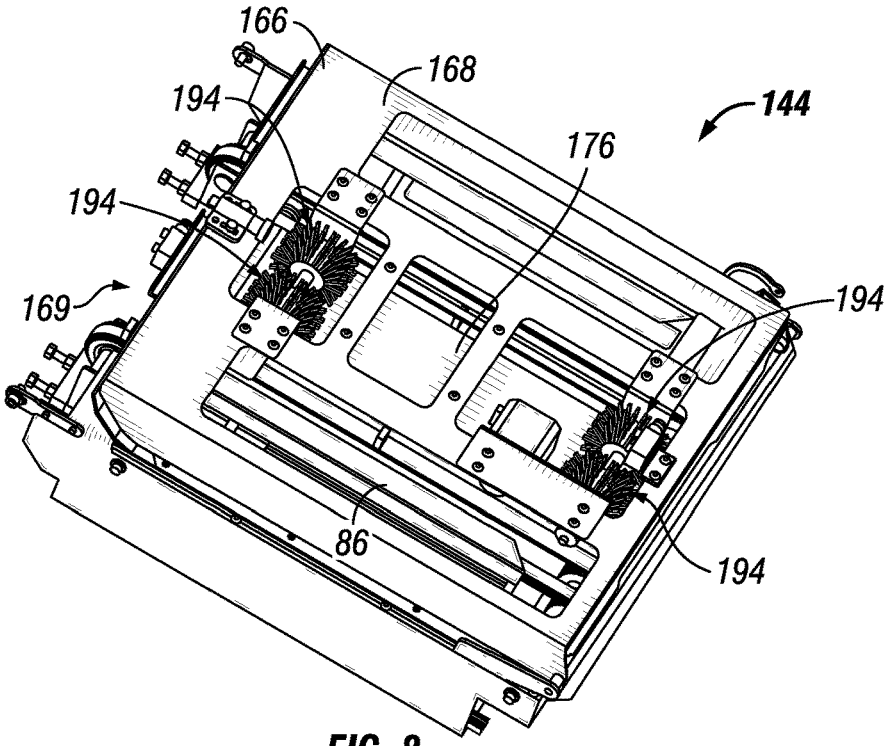
FIG. 8 is a side perspective view of another embodiment of an accumulator unit that can be used in the high-speed collating punch system of FIG. 1.
Figure 9:
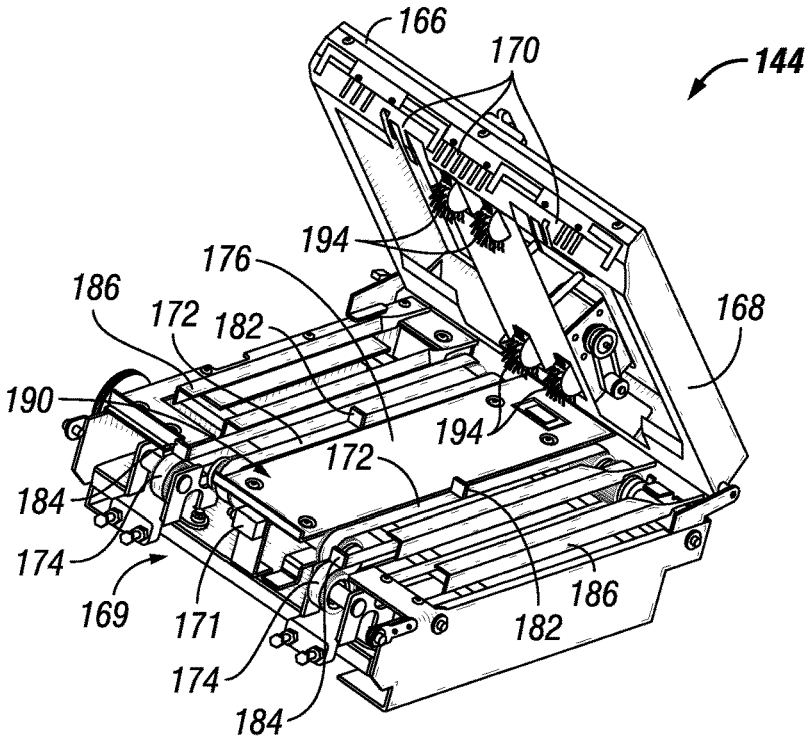
FIG. 9 is a top perspective view of the accumulator unit of FIG. 8, with the upper frame rotated away.

An alternative embodiment of an accumulator 144 that can be used in the punching and collating system 10 disclosed herein is shown in FIGS. 8 and 9. Like the accumulator shown in FIGS. 5-7, this accumulator 144 includes collating belts 172 and tapping belts 174 disposed on opposing sides of a media support surface 176, with lower stops 182 and upper stops 184, respectively, a shoulder 171 at the inlet end 169 and reciprocable side bars 186, which operate as discussed above.

In this embodiment, however, the upper frame 168, which is hingedly attached to the accumulator 144, supports a media driving mechanism that includes drive rollers 194 (instead of brushes) that are positioned to lie opposite the media support surface 176 and contact the back sides of sheets 12 that are received into the accumulator 144. These drive rollers can be of the type of resilient polymer material that is commonly used in media driving and picking mechanisms, such as are used in photocopiers, printers and the like. Like the brushes 94 discussed above, the rollers 194 can be powered by a single motor 195, and counter-rotate relative to the collating belts 172 and tapping belts 174 to assist in moving individual sheets 12 and/or a completed lift 36 within the accumulator 144.

The accumulator 144 of FIGS. 8 and 9 also includes some additional advantageous features. In this embodiment the leading edge 166 of the upper frame 168 includes some downwardly angled media guides 170, which are positioned to lie just above and beyond the shoulder 171 when the upper frame 168 is in the closed position. These media guides 170 contact the back sides of media sheets 12 as they enter the proximal end 169 of the accumulator, and thereby assist in causing the media sheets 12 to drop into the drop region 190 below the shoulder 171. This helps to assist the "shingling" action that allows the lift 36 to rapidly and accurately accumulate in the drop region in the book order.

Whether the media driving mechanism includes brushes 94, as in FIG. 6, or drive rollers 194, as in FIG. 8, when a given lift 36 is completely assembled, the collating belts 72 and tapping belts 74 can move in conjunction with the media driving mechanism to discharge the lift 36 as a unit into the media slot 112 of the punching die assembly 46, as depicted in FIG. 11. Moreover, it is to be understood that the collating punch system 10 disclosed herein can be configured without the media driving mechanism at all, and rely only on operation of the collating and tapping belts 72, 74 (and gravity) for transporting sheets of media and accumulated lifts within the accumulator 44.

The punching die assembly 46 is positioned to receive sheet lifts 36 from the accumulator 44, and is configured to punch binding holes 16 of a selected configuration in the lower edge 96 of the sheets 12 of the lift 36, and to discharge the punched lift 36 to the discharge mechanism 48. A perspective view of a punching die assembly 46 that can be used with the collating punch system 10 disclosed herein is shown in FIG. 9, and a cross-sectional view of the lower portion of the accumulator 44 and the central portion of the punching die assembly 46 is shown in FIG. 13.

The punching die assembly 46 generally includes a frame 98, a removable die unit 100, a media slot 112 for allowing passage of a lift 36 transversely through the frame, and a motor 102 for activating the die unit 100 to simultaneously punch multiple holes 16 through all sheets 12 in the lift 36. The removable die unit 100 slides into a slot in the side of the frame 98, and is shown partially removed from the punching die frame 98 in FIG. 9. A locking lever 104 is provided to allow the die 100 to be fixed in its installed position, allowing individual dies 100 to be removed for maintenance or to be exchanged for different dies. The die unit 100 includes a media slot 113 that aligns with the media slot 112 when the die unit is installed in the frame 98, and includes a set of retractable stop gates 114.

The die unit 100 includes an array of pins 106 that are attached to a moveable frame bar 108 and are normally positioned above the media slot 113. The pins 106 of the die unit 100 can be can be configured to produce any desired size or shape of holes 16 (e.g. round, square, rectangular, etc.), and any number and spacing of them. The spacing of the pins 106 can vary in order to vary the space between holes 16 or groups of holes 16. Additionally, the stop gates 114 are positioned slightly downstream of the pins 106 in the die unit 100 (relative to the direction of passage of media sheets through the system), so that different dies 100 can have different distances between the pins 106 and the stop gates 114, to allow a different spacing of the holes 16 from the adjacent edge (the lower edge 96 in FIG. 10) of the sheets 12 of the lift 36.

When the die unit 100 is inserted into the punching die frame 98, the frame bar 108 engages with a cam actuation mechanism 110 that can rapidly lower the bar 108, to thereby push the pins 106 downward to punch holes in the sheets of the lift, and then retract the pins therefrom. The die unit 100 can include a spring (115 in FIG. 13) that keeps the frame bar 108 and pins 106 in the desired position for insertion of the die unit 100 into the die frame 98, when the die unit 100 is outside of the punching die assembly 46. The cam actuation mechanism 110 is powered by the motor 102, allowing the punching die assembly 46 to punch in response to commands from the controller 52.

Before a lift 36 of sheets 12 is received from the accumulator 44, the pins 106 are normally held in the retracted position to allow passage of the lift 36 into the media slots 112, 113, and the retractable stop gates 114 of the die 100 are extended across the media slot 112 to stop the bottom (i.e. leading) edge 96 of the lift 36 of sheets 12 at a desired position within the slot 112, past the location of the pins 106. After the lift 36 is inserted into the media slot 112 and before punching, the upper stops 84 and the side bars 86 can be activated to tap the top edge 97 and lateral edges 99 of the lift to ensure alignment of the sheets 12. Following this final alignment step, the cam actuation mechanism 110 is activated to drive the pins 106 of the die unit 100 through the sheets 12, punching the holes 16 in the desired configuration, and then retracts the pins 106.

Figure 12:
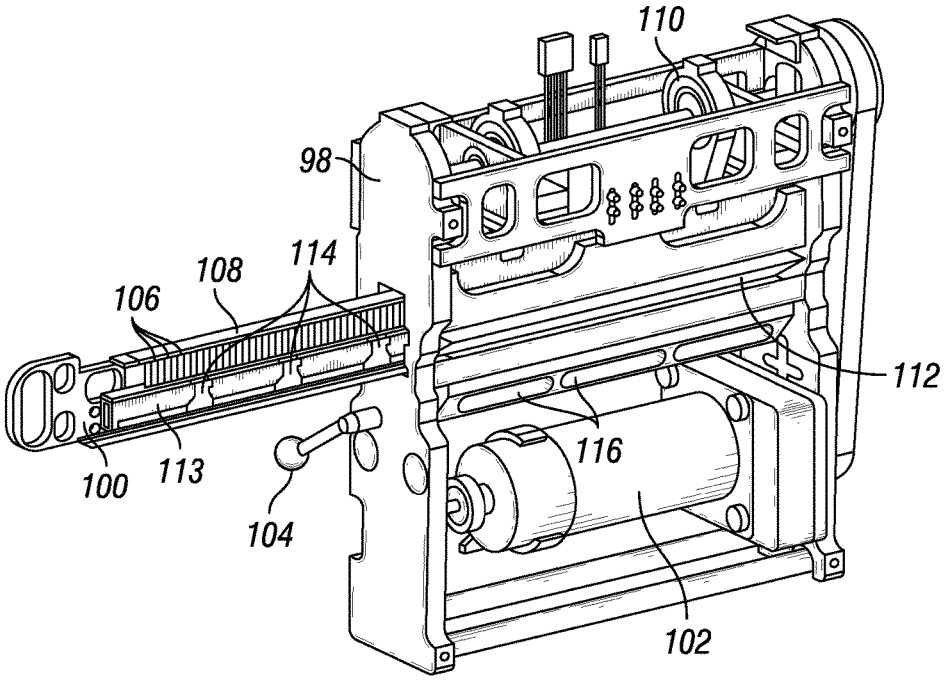
FIG. 12 is a perspective view of a punching die unit that can be used with the high-speed collating punch system disclosed herein.

Referring to FIGS. 4 and 12, disposed in the punching die assembly 46, below the media slot 112 and the die unit 100, are one or more waste passageways 116, which are provided to allow waste from the punching operation to drop through a waste chute 118 that extends from the punching die assembly 46 to a waste container 120 therebelow. The waste container 120 can include a door or other openable feature that allows a user to periodically remove and discard the waste from the punching operation.

Referring to FIGS. 3 and 4, after each lift 36 of sheets 12 is punched, the stop gates 114 are retracted and the media driving mechanism (whether including brushes 94 or drive rollers 194) and the collating and tapping belts 72, 74 of the accumulator 44 are reactivated to move the punched lift 36 of sheets 12 entirely through the media slot 112 and into the discharge mechanism 48, which grasps the punched lift 36 and transports it away from the accumulator 44 and the punching die assembly 46 and toward the discharge slot 32. In this way the stopping and aligning mechanism is also used to discharge the lift 36 beyond the punching die assembly after the sheets 12 are punched. At the same time, the collating and tapping belts 72, 74 can be further rotated by their respective drive pulleys 78 so that the stops 82, 84 of the respective belts are positioned back at the position shown in FIGS. 6 and 10, ready to receive more sheets 12 to accumulate a subsequent lift 36.

Advantageously, the accumulator 44 and discharge mechanism 48 can be configured to allow accumulation to proceed for one lift 36 while a previous lift 36 is being punched in the punching die assembly 46. For example, multiple stops (not shown) on the collating and tapping belts 72, 74 can allow the accumulator 44 and the discharge mechanism 48 to discharge one lift 36 of sheets from the punching die assembly 46 while simultaneously transporting a subsequent lift 36 from the drop region 90 into the media slot 112 of the punching die assembly 46. Thus, rotation of the belts 72, 74 can bring a new set of stops into position for each successive lift 36, thus facilitating higher speed operation.

An additional feature of the accumulator 44 that operates when the punched lift 36 is handed off to the discharge mechanism 48 is shown in FIGS. 5-7. The upper frame 68 can include a sheet sensor 122 (visible in FIG. 5) near the distal end 70, which is positioned above a reflector plate 124 (visible in FIGS. 6-7) on the media support surface 76 near the distal end 70. This sheet sensor 122 is coupled to the controller 52, and is configured to detect the presence or absence of a lift 36 of sheets 12 in the distal region 70 of the accumulator 44. The sheet sensor allows the controller 52 to detect when a lift 36 is moved into the punching die 46, and to detect when that lift leaves the media support surface 76 and passes through the media slot 112 in the punching die assembly 46. This sensor 122 allows the controller 52 to further track the progress of lifts 36 through the system 10 by detecting the entry of the punched lift 36 into the discharge mechanism 48, and also to detect possible malfunctions such as paper jams in the system. The accumulator embodiment shown in FIGS. 8 and 9 also includes a sheet sensor at the distal end of the accumulator, which functions in the same way.

The discharge mechanism 48 is similar in many respects to the sheet transport mechanism 42, and generally includes drive rollers, guides, belts and other suitable devices for transporting the punched lift 36 of sheets 12 as a unit from the punching die assembly 46 through the discharge slot 32 to the output tray assembly 50. Such media transport systems are well known and widely used in photocopiers and other document handling systems that are commercially available.

Figure 14:
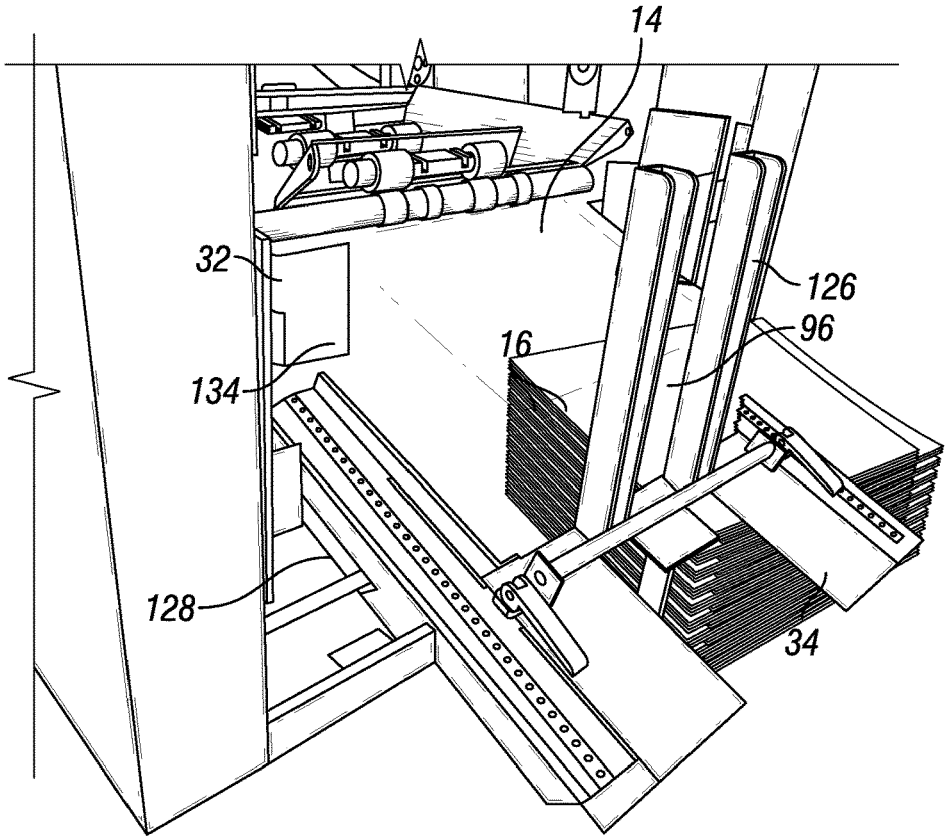
FIG. 14 is a detail perspective view of the discharge tray having a set of collated and punched lifts disposed thereon.

With reference to FIGS. 3, 4 and 14, the output tray assembly 50 includes a level output tray 34 that provides a surface for discharge and stacking of collated and punched lifts 36. The output tray 34 includes a pair of upright stop bars 126 positioned to prevent discharged lifts 36 of media from falling off of the output tray 34. The output tray assembly 50 also includes a lifting mechanism 128, to which the output tray 34 is attached, so that the level of the output tray 34 can be adjusted downward as successive lifts 36 of sheets are discharged through the discharge slot 32, so that each punched lift 36 that is discharged can come to rest atop a previously punched lift 36 without obstruction or excessive drop. As noted above, the sheets for each lift of each book enter the media intake system 40 face up, but are inverted before entering the accumulator 44, and will thus be discharged through the outlet 32 in the inverted orientation. The collated and punched books will thus be provided on the output tray 34 face down (though of course any or all of the pages, covers, etc. of a given book can be printed on both front and back sides).

Advantageously, the discharge mechanism 48 also includes a lateral shift mechanism 130 that moves the entire discharge mechanism 48 laterally with respect to the punching die assembly 46 and output tray assembly 50, as indicated by arrow 132 in FIG. 3. This lateral shift mechanism 130 can laterally shift between two or more lateral positions in order to laterally offset a discharge position of punched lifts 36 upon the output tray 34. This can be desirable for selectively placing the lifts for each book in a laterally offset position relative to the lifts for prior and successive books. For example, the discharge mechanism 48 can be laterally shifted between two positions, so that, viewing FIG. 14, the lifts for one book 14 are all received at a first lateral position, and lifts for a second book 14 are received atop the first book 14 at a second lateral position, after which the discharge mechanism 48 shifts back to the first position and the lifts for a third book 14 are placed at the first lateral position, and so on.

In this way, the lateral shifting mechanism 130 stacks all lifts 36 for a single book 14 on the output tray 34 in the book order in a common lateral position that is laterally offset from a lateral position of preceding and following books 14. The lateral shifting mechanism 130 thus creates an alternating staggered offset position of successive books 14 in a stack 134 on the output tray 34, as shown in detail in FIG. 14, with the individual copies of the book 14 lying in distinct positions and the punched holes 16 aligned along the same edge (the bottom edge 96) for each book 14 in the stack 134. This output configuration allows the stack 134 to be easily moved, and allows the collated books 14 to be easily grasped and removed from the stack 134 for binding. With the punched holes 16 all similarly located along an aligned edge 96 on successive books 14, and the books being in a staggered arrangement, a user can easily grasp and take individual books 14 from the stack and insert them into a binding machine (not shown) to bind the book.

The system disclosed herein thus allows a user to rapidly and automatically collate sheets of media of various types into groups or lifts, and punch holes of a desired configuration in preparation for binding. As shown in FIG. 15, the completed books 14 can include sheets 12 having rectangular holes **16*a* and a comb-type binding 18, or rectangular holes 16*b* and a wire-type binding 20, or circular holes and a coil-type binding 22, or other configuration. Advantageously, the collating punch system 10 thus reduces the time and labor involved in compiling and binding books or documents 14** with various types of bindings, including comb-, wire- and coil-type bindings.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. An accumulator for an automatic sheet media punching and collating system, comprising:

an upper proximal end, having a shoulder;

a lower distal end;

a moveable collating belt, disposed below the shoulder, extending from the proximal end to the distal end, having an upwardly extending lower stop with an accumulating position opposite the shoulder and toward the distal end, defining a downwardly inclined drop region between the shoulder and the lower stop, the lower stop configured to contact a lower edge of sheets of media sequentially received at the proximal end, whereby the sheets stop against the lower stop and accumulate in the drop region in a lift in a book order, the collating belt being selectively moveable to discharge the lift as a unit toward the distal end; and a selectively moveable tapping belt, disposed below the shoulder and parallel to the collating belt, having an upper stop, being moveable both independently of and in concert with the collating belt, the upper stop being configured to contact an upper edge of the sheets in an accumulated lift to align the upper edges, the collating and tapping belts being configured to move in concert to discharge the lift toward the distal end.

2. An accumulator in accordance with claim 1, wherein the collating belt is selectively moveable to adjust the accumulating position for a selected size of sheet media.

3. An accumulator in accordance with claim 1, further comprising a media support surface, disposed below the shoulder, adjacent to the collating and tapping belts, the upper and lower stops extending above the media support surface.

4. An accumulator in accordance with claim 3, further comprising:

an upper frame, positioned opposite the media support surface; and a media driving mechanism, attached to the upper frame, configured to contact and move the sheet media in concert with the collating and tapping belts to transport sheet media toward the distal end.

5. An accumulator in accordance with claim 4, wherein the media driving mechanism is selected from the group consisting of rotatable drive rollers and rotatable brushes.

6. An accumulator in accordance with claim 3, wherein the collating belt and tapping belt comprise a pair of collating belts and a pair of tapping belts, one of each pair of belts being disposed on opposing sides of the media support surface.

7. An accumulator in accordance with claim 1, further comprising a pair of side bars, disposed on opposing lateral sides of the accumulator, configured to selectively reciprocally move inward to contact and align lateral edges of the lift of sheets prior to discharge at the distal end.

8. An accumulator in accordance with claim 1, further comprising a sheet sensor, disposed at the distal end, configured to detect the presence or absence of the lift of sheets.

9. An accumulator in accordance with claim 1, wherein the proximal end is configured to be connected to a multi-source sheet media intake and transport mechanism, configured for feeding sheets to the accumulator, and the distal end is configured to be connected to a punching die assembly, configured for punching holes in the lower edge of the lift.

10. An accumulator for a sheet media punching and collating system having a multi-source sheet media intake mechanism disposed above a punching die assembly, the accumulator disposed at an incline between the intake mechanism and the punching die assembly and comprising:

an inlet, at an upper position, having a shoulder, configured to be disposed adjacent to the multi-source sheet media intake mechanism;

an outlet, disposed below the inlet, configured to be disposed adjacent to the punching die assembly;

a pair of selectively moveable collating belts, disposed below the shoulder, each having an upwardly extending lower stop, and having an accumulating position with the lower stops opposite the shoulder and toward the outlet, defining a downwardly inclined drop region between the lower stops and the shoulder, whereby a lower edge of sheets of media received at the inlet can contact the lower stops and sequentially accumulate in the drop region in a book order to form a lift; and a pair of selectively moveable tapping belts, disposed below the shoulder and parallel to the collating belts, each tapping belt having an upwardly extending upper stop and being moveable independently of the collating belts to contact an upper edge of the lift to align the sheets, and moveable in concert with the collating belts to discharge the lift through the outlet to the punching die assembly.

11. An accumulator in accordance with claim 10, further comprising:

a media support surface, disposed below the shoulder, adjacent to the collating and tapping belts;

an upper frame, hingedly attached to the accumulator opposite the media support surface, the upper frame having an open position and a closed position; and a media drive mechanism, attached to the upper frame, configured to operate in concert with the collating and tapping rollers to transport sheet media within the accumulator.

12. An accumulator in accordance with claim 11, wherein the media driving mechanism is selected from the group consisting of rotatable drive rollers and rotatable brushes, positioned to counterrotate opposite the collating and tapping belts.

13. An accumulator in accordance with claim 10, further comprising a pair of side bars, disposed on opposing lateral sides of the accumulator, configured to selectively reciprocally move inward to contact and align lateral edges of the lift of sheets prior to discharge to the punching die assembly.

14. A method for accumulating a selected quantity of sheets of media in an automatic punching and collating system having a multi-source sheet media intake mechanism and a punching die assembly, comprising:

receiving into a downwardly inclined drop region in an accumulator, one at a time in a book order, finished media sheets from the multi-source sheet media intake mechanism;

stopping a first selected quantity of a plurality of the finished media sheets, in the book order, upon a stopping mechanism in the drop region;

tapping at least top edges of the first selected quantity of the media sheets with a tapping mechanism, while the first selected quantity of sheets are within the accumulator; and discharging the first selected quantity of finished media sheets, as a unit, to the punching die assembly for punching, using the stopping mechanism.

15. A method in accordance with claim 14, further comprising:

discharging the first selected quantity of finished media sheets beyond the punching die assembly after they are punched, using the stopping mechanism;

stopping a second selected quantity of the media sheets in the book order, after discharge of the first selected quantity, upon the stopping mechanism; and discharging the second selected quantity of finished media sheets to the punching die assembly using the stopping mechanism.

16. A method in accordance with claim 14, wherein:

stopping the first selected quantity of the media sheets comprises stopping the first selected quantity of sheets upon lower stops of one or more selectively moveable collating belts within the drop region;

tapping the first selected quantity of the media sheets comprises tapping the top edges with upper stops of one or more selectively moveable tapping belts; and discharging the first selected quantity of media sheets comprises simultaneously activating the collating belts and the tapping belts to move the selected quantity of sheets as a unit to the punching die assembly.

17. A method in accordance with claim 14, further comprising contacting lateral edges of the accumulated sheets of media with a pair of selectively reciprocally moveable side bars, disposed on opposing lateral sides of the accumulator, to align lateral edges of the unit of sheets prior to punching by the punching die assembly.

18. A method in accordance with claim 14, further comprising moving the stopping mechanism to adjust a size of the drop region for a selected size of sheet media.

* * * * *